US012766582B2

(12) United States Patent
Matsuki et al.

(10) Patent No.: US 12,766,582 B2
(45) Date of Patent: Oct. 20, 2026

(54) METAL SHEET SHEARING WORK METHOD, PRESSED COMPONENT MANUFACTURING METHOD, METAL SHEET, AND SHEARING DIE FOR METAL SHEET

(71) Applicant: JFE STEEL CORPORATION, Tokyo (JP)

(72) Inventors: Yuichi Matsuki, Tokyo (JP); Kinya Nakagawa, Tokyo (JP); Toyohisa Shinmiya, Tokyo (JP); Yuji Yamasaki, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 865 days.

(21) Appl. No.: 18/010,126

(22) PCT Filed: Jun. 8, 2021

(86) PCT No.: PCT/JP2021/021696
§ 371 (c)(1),
(2) Date: Dec. 13, 2022

(87) PCT Pub. No.: WO2022/004296
PCT Pub. Date: Jan. 6, 2022

(65) Prior Publication Data

US 2023/0264248 A1 Aug. 24, 2023

(30) Foreign Application Priority Data

Jun. 30, 2020 (JP) ..... 2020-112738

(51) Int. Cl.
*B21D 28/16* (2006.01)
*B21D 28/14* (2006.01)

(52) U.S. Cl.
CPC ..... *B21D 28/16* (2013.01); *B21D 28/14* (2013.01)

(58) Field of Classification Search
CPC ..... B21D 28/16; B21D 28/14
See application file for complete search history.

(56) References Cited

U.S. PATENT DOCUMENTS 7,842,142 B1 * 11/2010 Kusumi ..... C21D 1/673 148/531
10,022,770 B2 * 7/2018 Grimm ..... B21D 28/16
(Continued)

FOREIGN PATENT DOCUMENTS

EP 0 864 384 A2 9/1998
JP S48-62662 A 9/1973
(Continued)

OTHER PUBLICATIONS

Nov. 22, 2023 Extended Search Report issued in European Patent Application No. 21834176.6.
(Continued)

*Primary Examiner* — Omar Flores Sanchez
(74) *Attorney, Agent, or Firm* — Oliff PLC

(57) ABSTRACT

A shearing work technology of metal sheets, such as high-strength steel sheets, is excellent in stretch flange crack resistance and delayed fracture resistance of the sheared end surface. A metal sheet shearing work method including: applying double shearing work to an end portion of at least one part of the metal sheet; and forming a first area having a cutting margin of a second shearing work of 5 mm or less in first cutting in the double shearing work. Second cutting in the double shearing work is carried out in a state where the movement on an end portion side of the first area is restrained. For example, by providing projection areas continuous to the first area and restraining the projection areas,
(Continued)

the movement on the end portion side of the first area is restrained.

20 Claims, 8 Drawing Sheets

(56) References Cited

U.S. PATENT DOCUMENTS

| | | | | |
|---|---|---|---|---|
| 2015/0101385 | A1* | 4/2015 | Marti | B21D 35/001 72/333 |
| 2015/0174635 | A1* | 6/2015 | Hirata | B21D 28/16 72/328 |
| 2016/0052039 | A1* | 2/2016 | Marti | B21D 19/005 72/332 |
| 2018/0141101 | A1* | 5/2018 | Sumida | B21D 53/14 |
| 2018/0345350 | A1* | 12/2018 | Hofstetter | B21D 19/005 |
| 2019/0151926 | A1* | 5/2019 | Koopmans | B21D 28/02 |
| 2025/0144693 | A1* | 5/2025 | Honda | B23D 35/001 |
| 2025/0146808 | A1* | 5/2025 | Lim | B21C 51/00 |
| 2025/0222507 | A1* | 7/2025 | Norita | B21D 28/16 |

FOREIGN PATENT DOCUMENTS

| | | | |
|---|---|---|---|
| JP | H07-9045 | A | 1/1995 |
| JP | H09-66496 | A | 3/1997 |
| JP | 2908989 | B2 | 6/1999 |
| JP | 2006-116589 | A | 5/2006 |
| JP | 2006-116590 | A | 5/2006 |
| JP | 2006-224121 | A | 8/2006 |
| JP | 2006-326672 | A | 12/2006 |
| TW | 200533490 | A | 10/2005 |

OTHER PUBLICATIONS

Yuzo Takahashi et al. "Improvement in Stretch Flange Ability of High-Tensile-Strength Steel Sheets By Piercing Under Tension Using Humped Bottom Punch". Journal of the JSTP, 2012, vol. 53, No. 617, pp. 569-573.

Takeo Nakagawa et al. "Cut-Off Punching Process—A New Method for Recovery of Stretchability of Sheared Edge". Journal of the JSTP, 1969, vol. 10, No. 104, pp. 665-671.

Dec. 13, 2022 International Preliminary Report on Patentability issued in International Patent Application No. PCT/JP2021/021696.

Jul. 13, 2021 International Search Report issued in International Patent Application No. PCT/JP2021/021696.

Aug. 30, 2022 Office Action issued in Japanese Patent Application No. 2020-112738.

Oct. 28, 2025 Office Action issued in Chinese Patent Application No. 202180047050.3.

Jun. 30, 2026 Office Action issued in Chinese Patent Application No. 202180047050.3 with concise statement of relevance.

* cited by examiner

METAL SHEET SHEARING WORK METHOD, PRESSED COMPONENT MANUFACTURING METHOD, METAL SHEET, AND SHEARING DIE FOR METAL SHEET

TECHNICAL FIELD

The present invention is a technology related to a metal sheet shearing work method in the manufacture of a pressed component by press forming, and the manufacture of the pressed component.

BACKGROUND ART

At present, automobiles have been required to improve fuel consumption by a reduction in weight and collision safety. For the purpose of achieving both the reduction in weight of a vehicle body and the protection of passengers in the event of a collision, high-strength steel sheets tend to be used for automobile components, particularly structural components. Particularly in recent years, as the high-strength steel sheets, ultrahigh-strength steel sheets having higher strength, i.e., a tensile strength of 980 MPa or more, have been applied to the vehicle body.

As one of the problems when the ultrahigh-strength steel sheets are applied to the vehicle body, a stretch flange crack in pressing and a delayed fracture after the manufacture of a pressed component are mentioned. In particular, countermeasures against the delayed fracture and the stretch flange crack occurring from the end surface after shearing work (hereinafter also referred to as sheared end surface) are serious problems in the steel sheets having a tensile strength of 980 MPa or more.

Herein, it is known that a large tensile stress remains in the sheared end surface. The remaining of the tensile stress poses a concern about the occurrence of the stretch flange crack and the delayed fracture with time in a product after pressing (pressed component) in the sheared end surface. To suppress these fractures in the sheared end surface, it is required to reduce a tensile residual stress or a work hardened layer in the sheared end surface.

As a simple method for reducing the tensile residual stress and the work hardened layer of the sheared end surface, a method is mentioned which includes performing shearing in a state where tension is applied using a stepped upper blade in hole punching (NPL 1), for example. As another method, a method is mentioned which includes dividing a shearing step into two steps and reducing a cutting margin of a second shearing step (NPL 2, PTL 1).

Herein, the latter method including reducing the cutting margin of the second shearing step is sometimes referred to as shaving or cut-off punching when the cutting margin is sufficiently small. In this specification, however, this method is referred to as "double shearing work" regardless of the size of the cutting margin.

In this specification, the "double shearing work" refers to processing in which the same end portion is subjected to first cutting, and then subjected to second cutting. The double shearing work is also referred to as double punching.

CITATION LIST

Non Patent Literatures

NPL 1: Yuzo Takahashi et al.: Improvement in stretch flange ability of high-tensile-strength steel sheets by piercing under tension using humped bottom punch, SOSEI-TO-KAKO, 53-617 (2012), 569-573

NPL 2: Takeo Nakagawa, Kiyota Yoshida: Cut-off punching process-A new method for recovery of stretchability of sheared edge-, SOSEI-TO-KAKO, 10-104 (1969), 665-671

Patent Literature

PTL 1: JP 2006-116590 A

SUMMARY OF INVENTION

Technical Problem

There are concerns about the stretch flange crack and the delayed fracture occurring from the sheared end surface of the high-strength steel sheets described above.

However, the method using the stepped upper blade has posed a problem that an effect of improving the stretch flange crack or delayed fracture resistance is relatively low.

The method using the "double shearing work" has required to reduce the cutting margin of the second shearing to obtain a marked effect in many cases. Therefore, when the method using the "double shearing work" is applied to mass production, position accuracy of several millimeters according to the cutting margin of the second shearing work is demanded for the placement position of a metal sheet to be sheared. This has posed a problem of difficulty in implementation.

Further, scraps on the punch-out side generated in the "double shearing work" are shavings of about several millimeters, which is the same as a punching margin. This has posed a problem of a risk that cut-off scraps are caught between shearing dies (cutting devices), and difficult to remove. There is a risk that such scraps are carried over to the next step in a state of being attached to a blank on the punched-out side, and damage both the die and the blank during press forming.

The present invention has been made in view of the above-described points. It is an object of the present invention to prevent the above-described fractures on the sheared end surface. To that end, it is an object of the present invention provide a method for improving the position accuracy in the shearing of the metal sheet, which is a problematic when the double shearing work is applied to mass production, for the double shearing work which is a shearing work method for reducing the tensile residual stress and the working area of the sheared end surface of the metal sheet. Further, it is another object of the present invention to provide a method for improving the scrap treatment capability on the punched-out side of the double shearing work. More specifically, it is an object of the present invention to provide a shearing work technology of metal sheets, such as high-strength steel sheets, excellent in stretch flange crack resistance and delayed fracture resistance of the sheared end surface.

Solution to Problem

To solve the problems, one aspect of the present invention is a method for shearing work a metal sheet, and the method includes: applying double shearing work to an end portion of at least one part of a metal sheet; forming a first area having a cutting margin of second shearing work of 5 mm or less in first cutting in the double shearing work; and carrying out second cutting in the double shearing work in a state where the movement on an end portion side of the first area is restrained.

According to an aspect of the present invention is a pressed component manufacturing method includes: when a metal sheet is formed into a pressed component through one or two or more times of press forming, shearing the metal sheet by the shearing work described in one aspect of the present invention is used as the metal sheet.

An aspect of the present invention is a metal sheet to be press-formed after the end portion of at least one part is cut by shearing work, in which the metal sheet has, as the end portion to be cut: a first area having a cutting margin of the shearing work of 5 mm or less; and projection areas continuous to the first area and having the cutting margin of the shearing work larger than that of the first area due to the fact that the projection areas project with respect to the first area.

An aspect of the present invention is a shearing die cutting the end portion of the metal sheet with an upper blade in a state where the metal sheet is restrained with a lower blade and a sheet holder, and the shearing die has a restraining tool restraining the movement on an end surface side of the end portion to be cut.

Advantageous Effects of Invention

The aspects of the present invention can reduce the tensile residual stress and the work hardened layer of the sheared end surface of a steel sheet generated in the shearing work in at least the first area. As a result, the aspects of the present invention can improve the stretch flange crack resistance and the delayed fracture resistance when the metal sheets, such as the high-strength steel sheets, are applied to various components, such as panel components and structure/frame components, of automobiles, for example.

The aspects of the present invention can improve the position accuracy of the metal sheet in the shearing work, and therefore enable the application to mass production.

Thus, the improvement of the position accuracy of the metal sheet reduces the cutting margin of the second shearing work which can be substantially applied in the application to mass production. Then, a marked improvement of the stretch flange crack resistance and the delayed fracture resistance can be obtained.

Further, the aspects of the present invention can improve the stability of the end portion the metal sheet in the cutting, and therefore the scrap shape becomes more stable, and the scrap treatment is facilitated. In particular, when the projection areas are provided, the projection areas having a relatively large cutting margin are included, which prevents the scraps from becoming like shavings. As a result, the scrap treatment is further facilitated.

DESCRIPTION OF EMBODIMENTS

Next, embodiments of the present invention will be described with reference to the drawings.

This embodiment gives a description taking a metal sheet as a blank to be press-formed into a pressed component as an example of a metal sheet to be sheared.

This embodiment is a technology suitable for a case where the target metal sheet is a high-strength steel sheet having a possibility of the occurrence of a stretch flange crack or a delayed fracture in an end portion caused by a tensile residual stress or work hardening of a sheared end surface of a steel sheet occurring in shearing work. The present invention is a technology which can be suitably applied in the case of high-strength steel sheets having a tensile strength of 590 MPa or more. The present invention is a technology more effective for high-strength steel sheets of 980 MPa or more and still more effective for high-strength steel sheets of 1180 MPa or more which are particularly concerned about the stretch flange crack or the delayed fracture.

Figure 1:
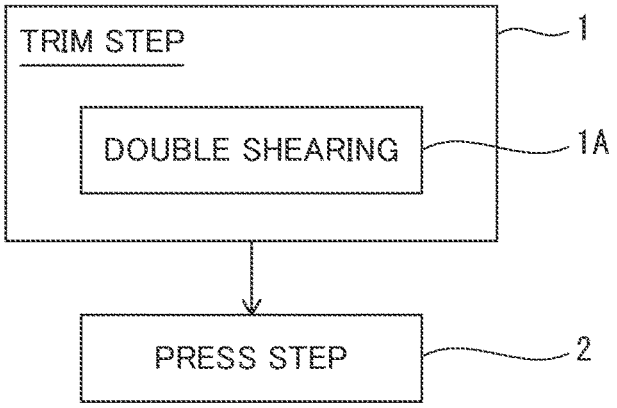
FIG. 1 is a view illustrating examples of steps according to an embodiment based on the present invention.

This embodiment has a trim step 1 and a press step 2 as pre-steps of press forming as illustrated in FIG. 1. A metal sheet 10 manufactured by this embodiment is suitable as the metal sheet 10 for press forming such that a tensile residual stress is generated in the sheared end surface.

In the trim step 1, the metal sheet 10 is cut into the contour shape according to the component shape of the pressed component.

In this cutting, shearing work is applied twice in succession (double shearing work 1A) to an end portion of at least one part in the entire periphery of the metal sheet 10.

<First Cutting in Double Shearing Work>

Figure 2:
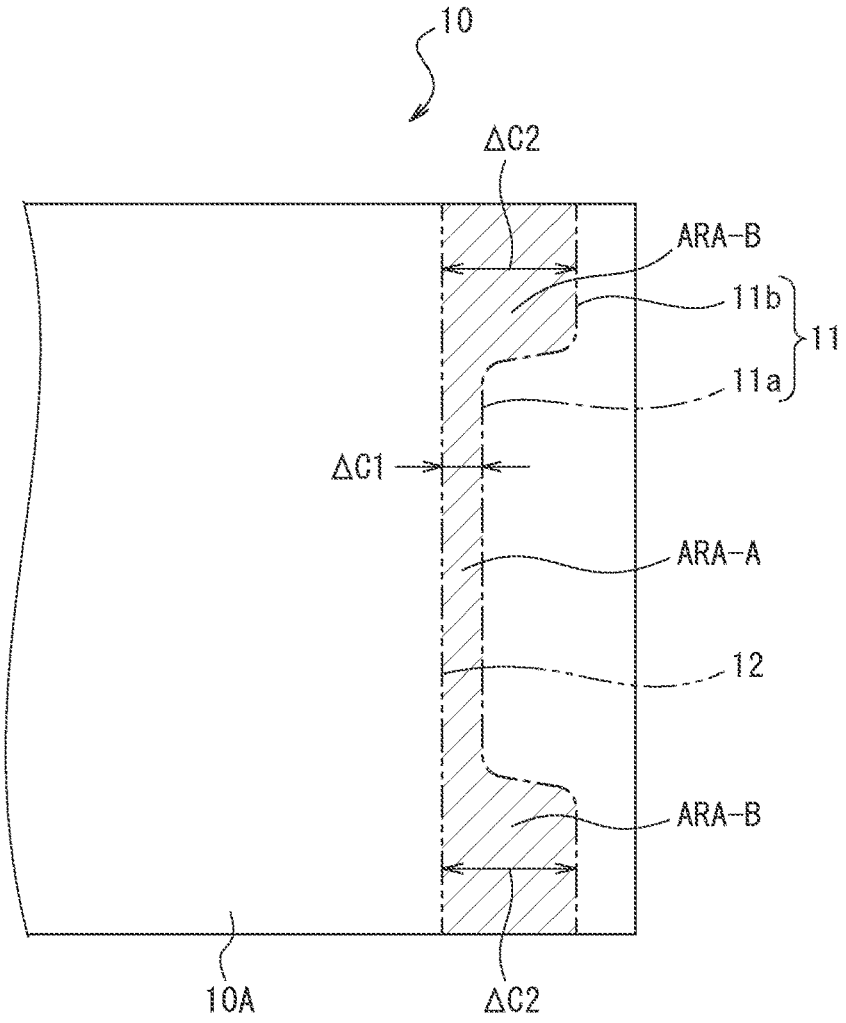
FIG. 2 is a plan view for explaining first cutting and second cutting by double shearing work.

The end portion to be subjected to the double shearing work is set such that the metal sheet 10 is cut into the target contour shape (position of reference numeral 12 in FIG. 2) by second cutting as illustrated in FIG. 2. Then, in first cutting, the metal sheet 10 is cut into a contour shape having a first area ARA-A and projection areas ARA-B continuous to the first area ARA-A with respect to the target contour shape (position indicated by the reference numeral 12) as indicated by the reference numeral 11 in FIG. 2. In FIG. 2, the position indicated by the reference numeral 11 is an end portion position after the first cutting. The reference numeral 12 indicates an end portion position after the second cutting. The reference numeral 11*a* indicates an end portion position of the first area ARA-A. The reference numeral 11*b* indicates an end portion position of the projection area ARA-B.

The first area ARA-A is an area set such that a cutting margin ΔC1 of second shearing work is 5 mm or less and preferably 3 mm or less. More specifically, the first area ARA-A is an area set to have the cutting margin ΔC1 exhibiting the above-described effects of the double shearing work.

Herein, the reason why the cutting margin ΔC1 is set to 5 mm or less is as follows. More specifically, when the cutting margin ΔC1 is excessively large, the deformation state in the shearing of the metal sheet is the same as that in a case where a material is cut by one shearing. Therefore, an effect of reducing a tensile residual stress or a work hardened layer by the double shearing work cannot be obtained. On the other hand, when the cutting margin ΔC1 is 5 mm or less, bending or shaving-like deformation peculiar to the double shearing work occurs in a material in the shearing. As a result, the effects of the double shearing work are obtained (see Examples described below).

The smaller the cutting margin ΔC1, the higher the effects of the double shearing work. However, it is preferable that the cutting margin of the second shearing is larger than the uneven shape of the sheared end surface generated by the first shearing. Therefore, the cutting margin ΔC1 of the second shearing is preferably 0.1 mm or more.

The projection areas ARA-B are areas where end portions 11*b* project with respect to the first area ARA-A. More specifically, the projection areas ARA-B have a cutting margin ΔC2 of the second shearing work set to a value larger than that of the first area ARA-A. The projection areas ARA-B are set to areas where the cutting margin of the second shearing work is 1 mm or more larger than that of the first area ARA-A, for example. More specifically, "ΔC2≥ΔC1+1" is established.

The projection areas ARA-B are set to the areas where the cutting margin of the second shearing work is 1 mm or more larger than that of the first area ARA-A. Thus, when the second cutting is performed in a state where the movement on the end portion side of the first area ARA-A is restrained, scraps containing the first area ARA-A and the projection areas ARA-B are likely to have a continuous shape.

Herein, the "movement on the end portion side is restrained" means restraining the movement of a cantilevered end portion (portion on the end surface side relative to the cut position), and the direction of the movement to be restrained indicates a direction away from the end surface of the end portion, for example.

In this embodiment, the cutting margins ΔC2 of the second shearing work in the projection areas ARA-B are set such that the end portions of the projection areas ARA-B project outward with respect to the position of an upper blade 23 to be used in the second shearing work. For example, it is preferable to set the cutting margins in the projection areas ARA-B to a value larger than the sum of the clearance in the cutting and the width of the upper blade 23.

<Second Cutting in Double Shearing Work>

In the second cutting, the first area ARA-A and the projection areas ARA-B are simultaneously cut in the state where the movement on the end portion side of the first area ARA-A is restrained. The first area ARA-A and the projection areas ARA-B are formed by the first cutting.

Figure 3:
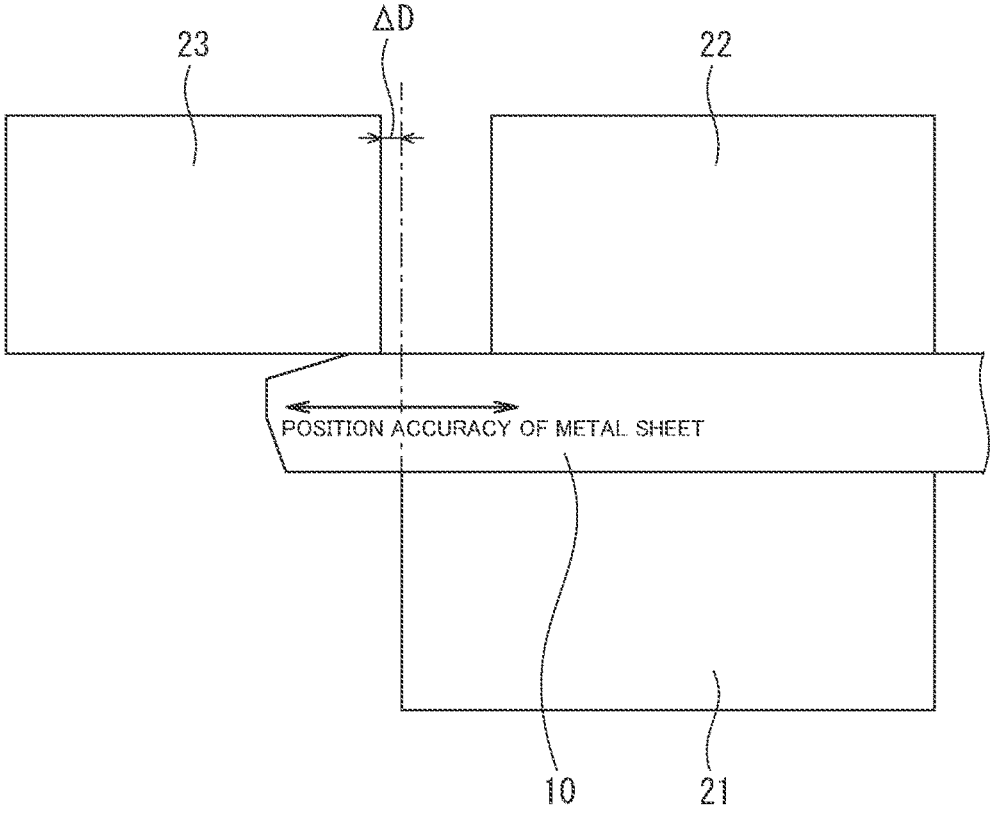
FIG. 3 is a schematic side view for explaining cutting of an end portion of a metal sheet.

A shearing die (cutting device) to be used in the double shearing work is a shearing die cutting the end portion of the metal sheet 10 with the upper blade 23. This cutting is carried out in a state where the metal sheet 10 is restrained with a lower blade 21 and a sheet holder 22 as illustrated in FIG. 3. The shearing die of this embodiment has restraining tools (guide members 30, rod bodies (jig 31), openings 23*a*) restraining the movement on the end surface side of the end portion to be cut as illustrated in FIGS. 4 to 10.

As illustrated in FIG. 3, the end portion is cut by moving the upper blade 23 relative to the lower blade 21 in the cutting direction which is the sheet thickness direction of the metal sheet 10 (downward in FIG. 3). This cutting is carried out in a state where a body 10A side (side away from the end portion) of the metal sheet 10 is restrained (fixed) with the lower blade 21 and the sheet holder 22. The lower blade 21 and the upper blade 23 contain a punch and a die, for example.

In a series of shearing work including performing double cutting, both the first cutting and the second cutting may be carried out using the same shearing dies (cutting devices) having the upper blade 23, the lower blade 21, and the sheet holder 22.

In this embodiment, however, the cutting in the second shearing work is carried out while the body 10A side of the metal sheet 10 is restrained with the lower blade 21 and the sheet holder 22 as with the first cutting. Further, the second cutting is carried out while the projection areas ARA-B are also restrained with the restraining tools, so that the movement on the end portion side of the first area ARA-A is restrained.

From the viewpoint of restraining the movement on the end portion side of the first area ARA-A, the projection areas ARA-B are preferably individually formed to be continuous to both sides in the end edge direction of the first area ARA-A as illustrated in FIG. 2.

Examples of restraining the projection areas ARA-B are described.

<First Restraint Example>

Figure 4:
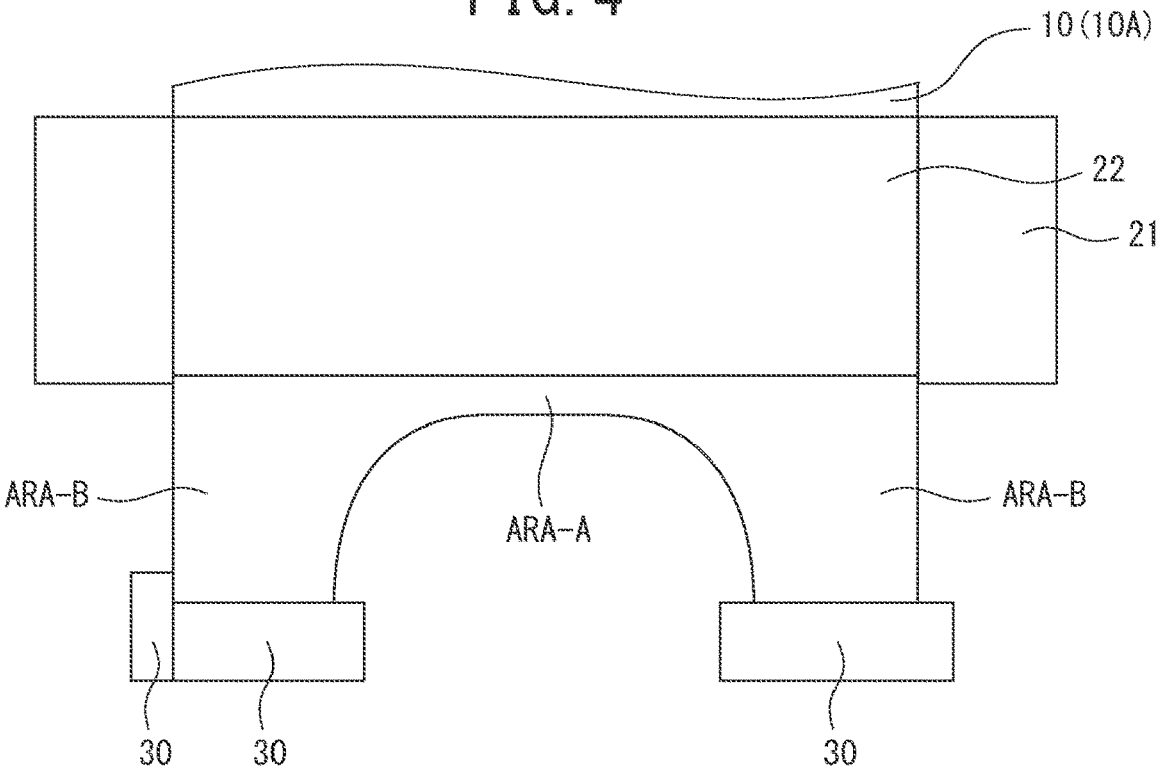
FIG. 4 is a plan view for explaining a first restraint example.
Figure 5:
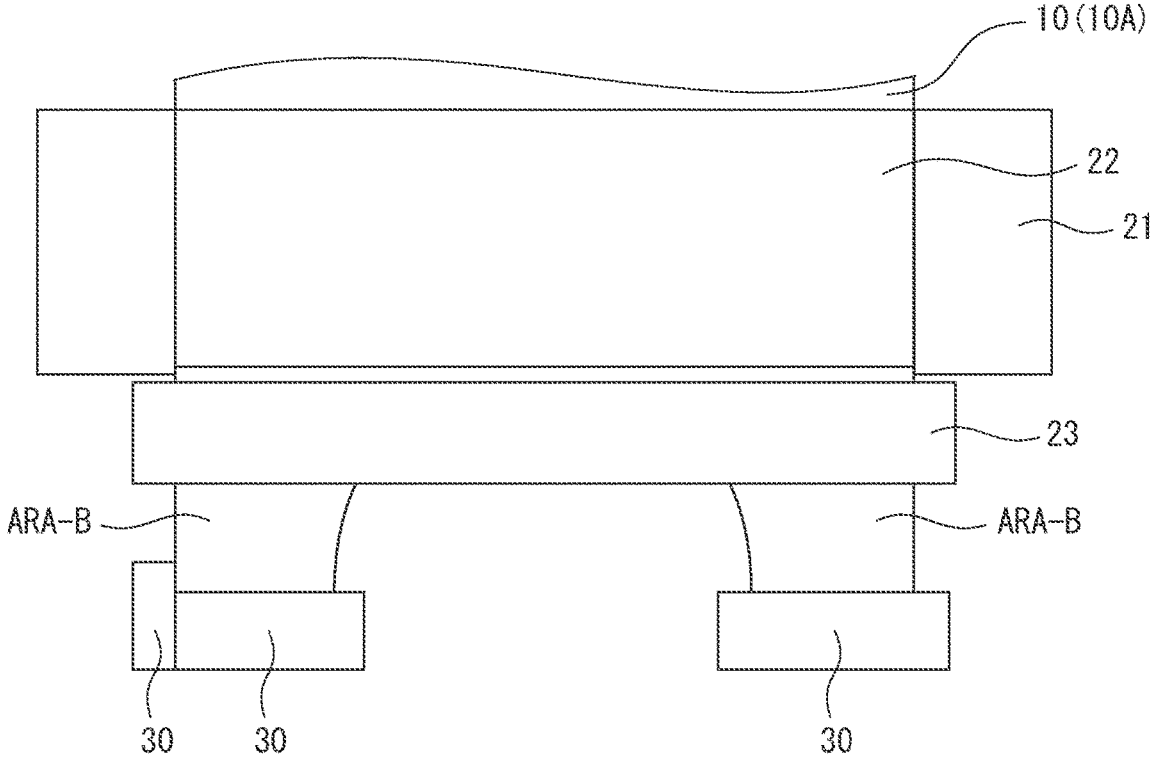
FIG. 5 is a plan view, in a state where an upper blade is arranged, for explaining the first restraint example.
Figure 6:
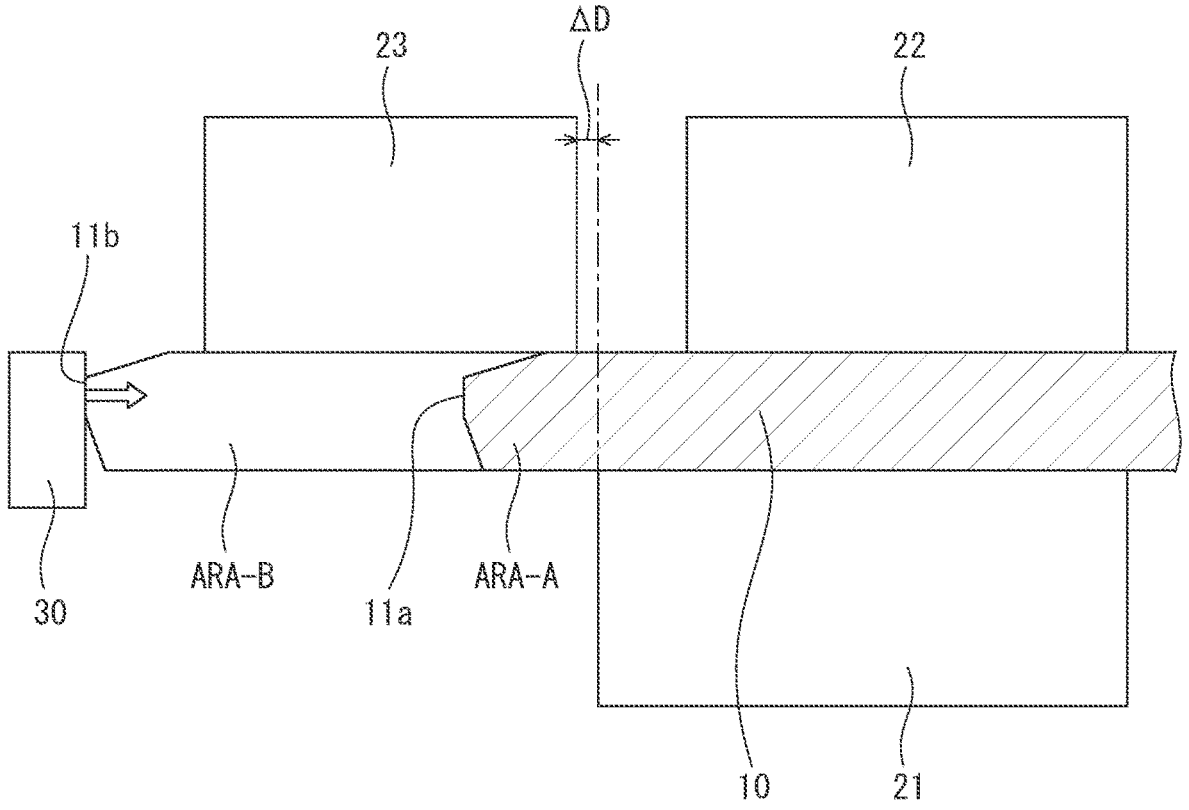
FIG. 6 is a side view for explaining the first restraint example.

A first restraint example is performed by causing the guide members 30 (pressing member) constituting the restraining tools to abut on end portions of the projection areas ARA-B as illustrated in FIGS. 4 to 6. More specifically, the guide members 30 press the projection areas ARA-B toward the body 10A side (cut position side of the cutting margin) of the metal sheet 10 and restrain the movement of the projection areas ARA-B. In the example of FIG. 3, the guide members 30 abut on the end surfaces of the end portions of the projection areas ARA-B and also abut on the end surfaces on the end surface sides of the end portions (surface sides in a direction intersecting the cutting direction).

In this example, the end portion 11*a* of the first area ARA-A is hidden under the upper blade 23 in plan view due to the small cutting margin ΔC1 as illustrated in FIGS. 5 and 6. However, the end portions 11*b* of the projection areas ARA-B are in a state of projecting outside with respect to the upper blade 23 in plan view.

<Second Restraint Example of Projection Areas ARA-B>

Figure 7:
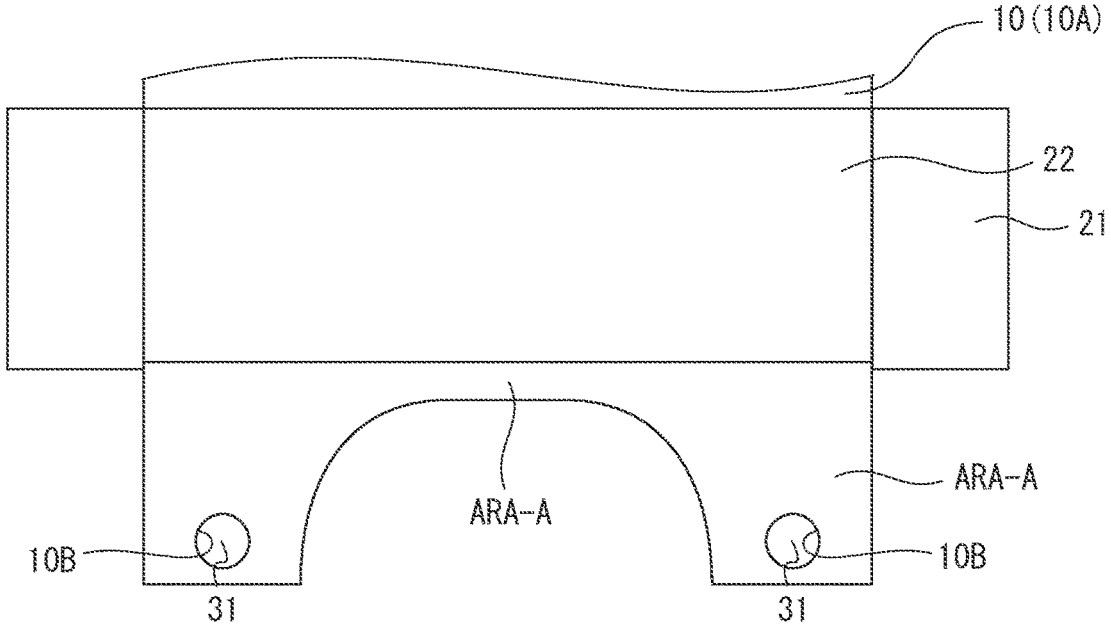
FIG. 7 is a plan view for explaining a second restraint example.
Figure 8:
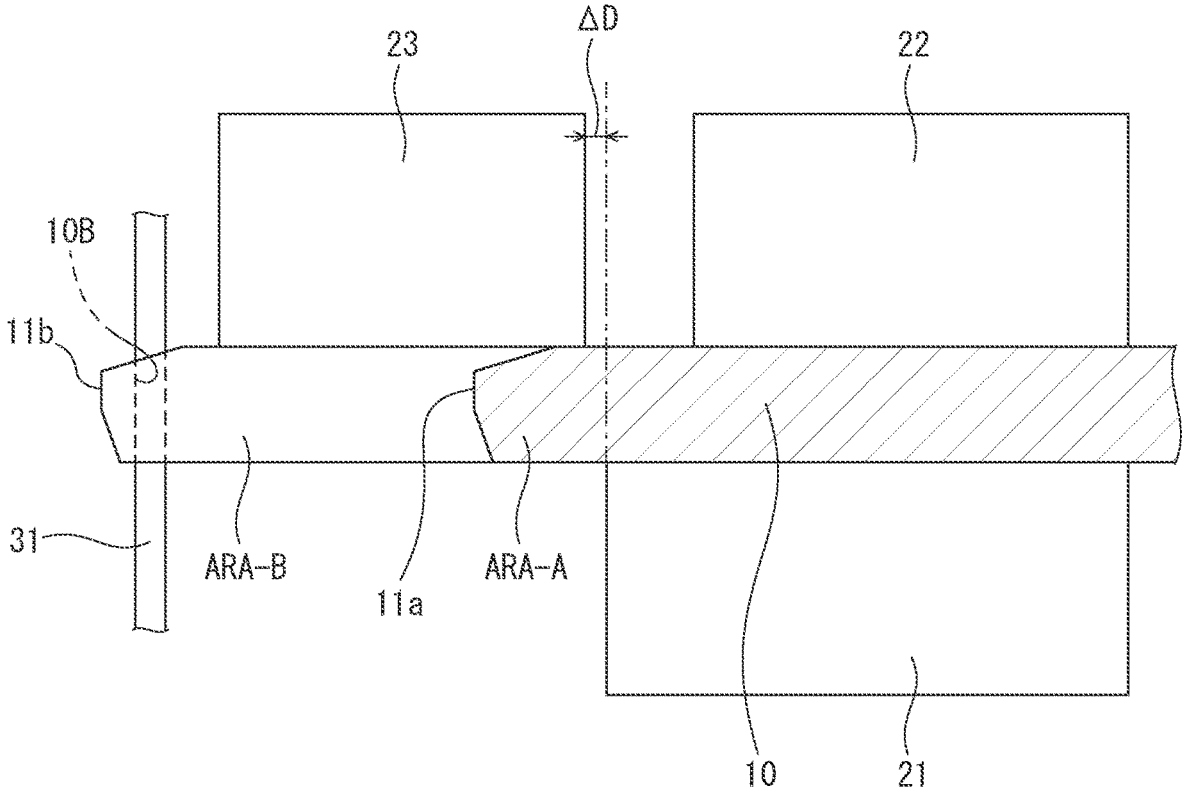
FIG. 8 is a side view for explaining the second restraint example.

In a second restraint example, the openings 10B formed by through holes for guiding are formed in portions projecting outward with respect to the arrangement position of the upper blade 23 in the projection areas ARA-B as viewed from the cutting direction (as viewed from above (paper surface direction) in FIG. 7) as illustrated in FIGS. 7, 8. The openings 10B may be formed before the second cutting, and therefore may be formed before the first cutting. Then, in the second cutting, the rod bodies (jigs 31) constituting the restraining tools which can be inserted into the openings 10B are inserted into the openings 10B. Thus, the movement of the rod bodies is restrained, so that the projection areas ARA-B are restrained. The rod bodies are fixed to the base or the like of the shearing die fixing the lower blade 21, for example.

A gap between the opening 10B and the jig 31 is preferably as small as possible within the range where the jig 31 can be inserted. The insertion may be an interference.

The configuration of the second restraint may be a configuration in which the openings 10B are bottomed holes and end portions of the rod bodies are inserted into the holes. In this case, portions of the openings 10B may have a recessed shape projecting downward.

The openings 10B may be provided at positions overlapping the arrangement position of the upper blade 23. In this case, the upper blade 23 is provided with the openings 10B not interfering with the jigs 31 inserted into the openings 10B.

<Press Step>

In the press step, the metal sheet 10, which has been subjected to the double shearing work based on the present invention, is press-formed using a press die to provide a desired pressed component. The press forming is, for example, stamping or drawing.

Herein, the description above describes a case where the double shearing work based on the present invention is applied to a part of the entire periphery of the metal sheet 10 as an example. However, the present invention is not limited thereto. For example, the double shearing work based on the present invention may be applied to the entire periphery of the metal sheet 10.

When the double shearing work based on the present invention is applied to an end portion of one part in the metal sheet 10, the following may be performed. More specifically, for example, the end portion where a tensile residual stress equal to or higher than a predetermined level is generated in the press forming is estimated by the CAE analysis. Then, the double shearing work based on the present invention is applied only to a side where the generation of the tensile residual stress equal to or higher than a predetermined level is estimated.

When the double shearing work based on the present invention is applied, there is no necessity of applying the double shearing work to all the end portions at the same time with respect to the outer periphery of the metal sheet 10. For example, the double shearing work based on the present invention is applied to a first side, and then the double shearing work based on the present invention may be separately applied to a second side. For example, the double shearing work based on the present invention may be individually carried out to two separate sides of the metal sheet 10. However, the first area ARA-A and the projection areas ARA-B forming a pair are cut at the same time.

As the pressed component shape becomes more complicated, the pressed component is manufactured by a larger number of stages of press forming. In this case, the double shearing work based on the present invention does not need to be always carried out before the first press forming. For example, the double shearing work based on the present invention may be performed after any press forming except the final press method. Further, one or two or more of press forming steps may be performed between the first shearing work and the second shearing work in the double shearing work based on the present invention.

The description above describes a case where the metal sheet 10, which has been subjected to the double shearing work based on the present invention, is press-formed to provide a target product as an example. However, even in the case of the metal sheet 10 used without being press-formed, the shearing work method of the present invention is applicable.

The other shearing work may be applied before the double shearing work based on the present invention.

(Modification)

Herein, in the embodiment in the description above, the projection areas ARA-B are formed to restrain the movement on the end portion side of the first area ARA-A. However, a restraint method is not limited thereto.

Next, a third restraint example is described in which the projection areas ARA-B are not formed.

Figure 9:
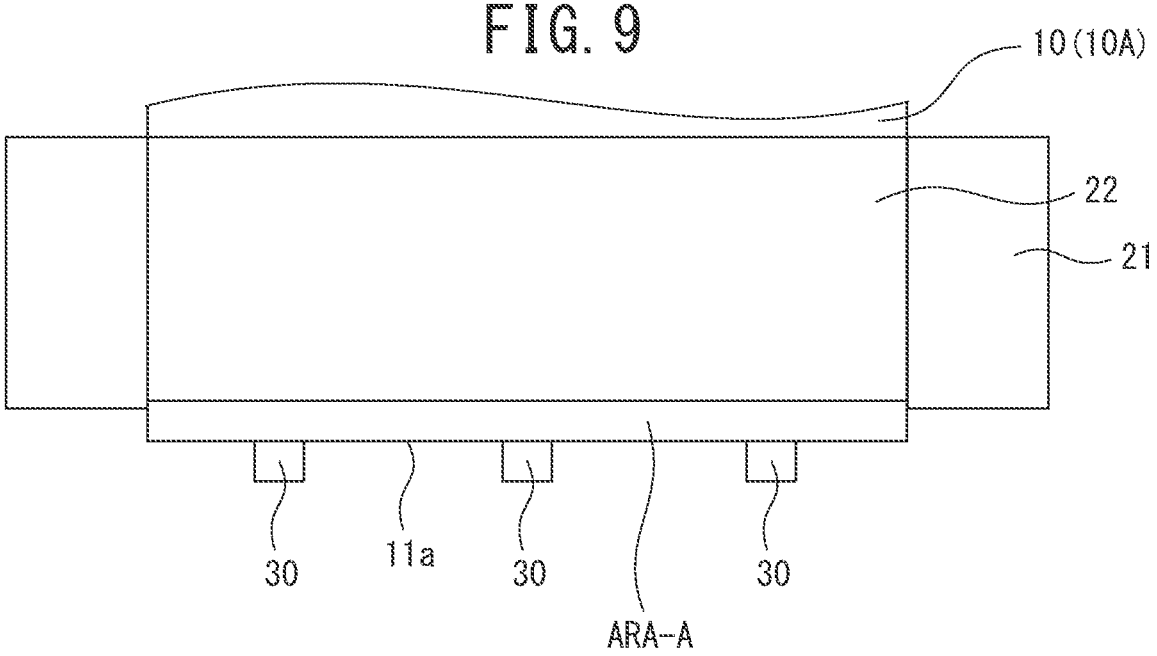
FIG. 9 is a plan view for explaining a third restraint example (modification)

In the third restraint example, the guide members 30 constituting the restraining tools are caused to directly abut on the end surface of the first area ARA-A, so that the end portion of the first area ARA-A is restrained as illustrated in FIG. 9.

In this case, however, the guide members 30 interfere with the upper blade 23 to be used in the second cutting in the cutting direction.

Figure 10:
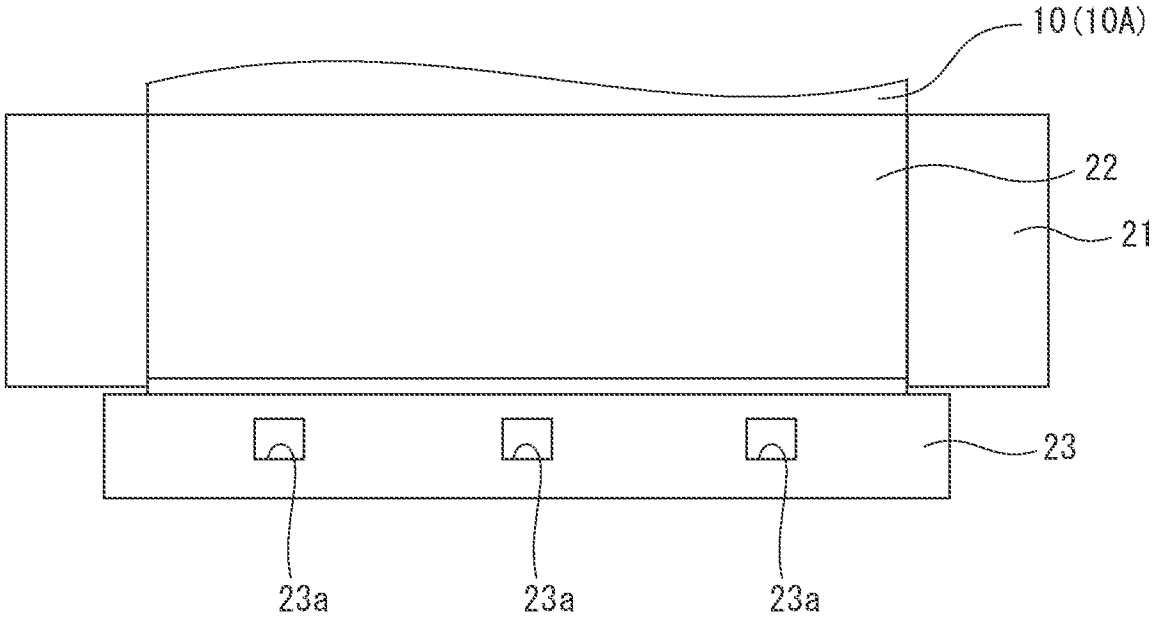
FIG. 10 is a side view for explaining the third restraint example (modification)
Figure 11A:
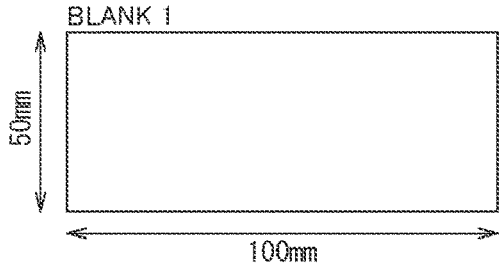
FIGS. 11A to 11D are views for explaining blanks used in Examples 1 to 4.
Figure 11B:
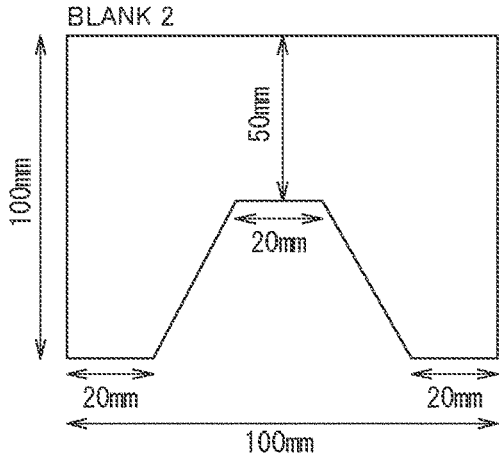
Figure 11C:
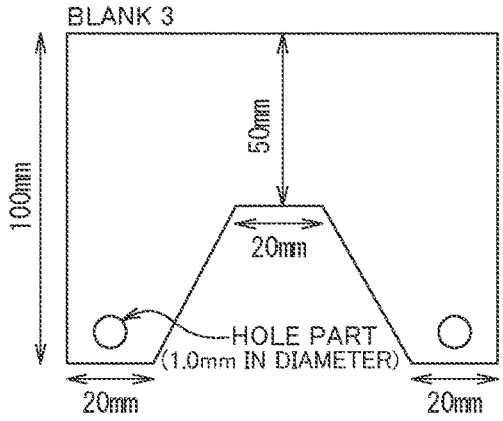
Figure 11D:
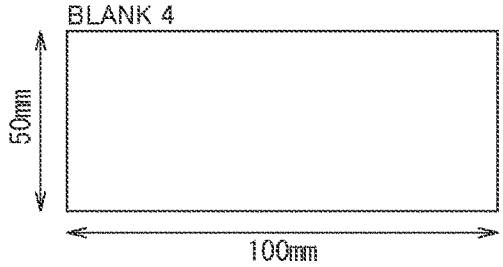

Therefore, in this third restraint example (modification), openings 23*a* allowing the passage of the guide members 30 in the cutting direction are formed in the upper blade 23 to be used in the second cutting as illustrated in FIG. 10.

Herein, as examples of the method for restraining the end portion side of the first area ARA-A, the first restraint example, the second restraint example, and the third restraint example are described. As the restraint of the end portion side of the first area ARA-A, these restraint methods can also be used in combination as appropriate.

(Operations and Others)

Next, operations and the like of the double shearing work of the embodiment based on the present invention are described.

According to this embodiment, the second cutting can be carried out with an appropriate cutting margin to at least the first area ARA-A in the shearing work of the metal sheet 10. As a result, at least in the first area ARA-A, the tensile residual stress and the work hardened layer of the sheared end surface can be reduced. As a result, the occurrence of the delayed fracture from the sheared end surface can be suppressed.

By restraining the movement on the end portion side of the first area ARA-A in the second cutting, the cutting of the end portion to be cut can be carried out in a stable state. As a result, the movement on the scrap side in the cutting is suppressed. This improves the position accuracy of the metal sheet 10 in the cutting. The position accuracy is preferably set to be 2 mm or less in a direction orthogonal to the sheared surface.

As a result, when this embodiment is applied to mass production, the cutting margin of the second shearing work which can be substantially applied is reduced. Thus, a marked improvement of the stretch flange crack resistance and the delayed fracture resistance can be obtained.

Hereinafter, a mechanism is described by which the position accuracy of the metal sheet 10 is improved while reducing the cutting margin of the second shearing work to an appropriate amount in this embodiment.

As illustrated in FIG. 3, in the cutting of the end portion, the upper blade 23 is moved in the cutting direction to cut the end portion in a state where the body 10A side of the metal sheet 10 is restrained with the lower blade 21 and the sheet holder 22, with respect to the metal sheet 10 to be cut.

When the double shearing work is applied to a sheared part of the metal sheet 10 as illustrated in FIG. 3, the vicinity of the end surface to be subjected to the double shearing work does not contact anything, and has a cantilevered shape.

Therefore, when the metal sheet 10 is installed in the shearing die and when a load is applied to the sheet and the die in the shearing work, the end portion of the metal sheet 10 relatively freely moves. Therefore, the position accuracy of the metal sheet 10 is reduced as compared with the cutting margin of the second shearing work where the double shearing work becomes effective. Therefore, there is a risk that the effects of the double shearing work cannot be stably obtained particularly in mass production.

On the other hand, in this embodiment, the projection areas ARA-B continuous to the first area ARA-A are provided as illustrated in FIG. 4, and the projection areas ARA-B are restrained. Thus, the second cutting is carried out in the state where the movement on the end portion side of the first area ARA-A is restrained.

No problems occur when the cutting margin $\Delta C2$ of the projection areas ARA-B is set to be larger than the cutting margin $\Delta C1$ of the first area ARA-A. However, with an increase in the cutting margin $\Delta C2$ of the projection areas ARA-B, useless scraps are generated. Therefore, from such a viewpoint, the upper limit of the cutting margin ΔC2 of the projection area ARA-B may be set.

Therefore, in this embodiment, the positioning of the first area ARA-A is enabled by the guide members 30 and the like in the vicinity of a part to be subjected to the double shearing work in the metal sheet 10.

Therefore, the position accuracy of the end portion of the metal sheet 10 is greatly improved, so that the effects of the double shearing work can be stably obtained in mass production.

Herein, the press of the guide members 30 against the end surface of the metal sheet 10 may be performed by a carrying machine before the shearing work or may be performed using a spring or the like.

Further, the scrap shape is stable in this embodiment. Further, in this embodiment, the projection areas ARA-B having a relatively large cutting margin are included after the second cutting, and therefore scraps do not become like shavings, and therefore the treatment of the scraps is facilitated.

As illustrated in FIG. 7, when the projection areas ARA-B are restrained using the openings 10B and jigs, the movement of the end portion of the metal sheet 10 can be restrained also in the cutting direction. Therefore, the position accuracy of the end portion of the metal sheet 10 in the cutting can be further improved.

A case of a method for fixing the position of the metal sheet 10 by pressing the guide members 30 against the end portion of the first area ARA-A having the cutting margin of the shearing work of 5 mm or less as in the modification (FIGS. 9, 10) is supposed. This case poses a problem that the die shape becomes complicated. Even in this method, however, the double shearing work can be performed in a state where the position accuracy of the end portion of the metal sheet 10 is improved. In this case, however, the relatively large projection areas ARA-B are not included, and therefore scraps become small, but the scrap shape is stable, and therefore the scrap treatment is facilitated.

This embodiment based on the present invention is effective when applied to the metal sheet 10 having a tensile strength of 980 MPa or more, which is concerned about the stretch flange crack or the delayed fracture.

The target metal sheet 10 preferably has a sheet thickness of 0.8 mm or more and 3.0 mm or less from the viewpoint of the press formability. The reason therefor is as follows. When the sheet thickness is 0.8 mm or less, the metal sheet 10 easily breaks in press forming. When the sheet thickness is 3.0 mm or more, a forming load in press forming increases. As a result, a very large facility capacity is required. Herein, the first area ARA-A is set to 5 mm or less and preferably 3 mm or less, because a punching margin which is expected to exhibit the effects by the double shearing work is considered to be about 5 mm or less as described in Examples. The projection areas ARA-B are set to areas where the cutting margin is at least 1 mm larger than that of the first area ARA-A, because it is considered that, when the punching margin increases by about 1 mm, the scrap treatment capability is improved.

(Effects)

This embodiment exhibits the following effects.

(1) This embodiment is the metal sheet 10 shearing work method, and the method includes: applying the double shearing work to the end portion of at least one part of the metal sheet 10; forming the first area ARA-A having the cutting margin of the second shearing work of 5 mm or less in the first cutting in the double shearing work; and carrying out the second cutting in the double shearing work in the state where the movement on the end portion side of the first area ARA-A is restrained.

This embodiment is a technology suitable for the case where the above-described metal sheet 10 is the high-strength steel sheet having a tensile strength of 980 MPa or more, for example.

This configuration can reduce the tensile residual stress and the work hardened layer of the sheared end surface of a steel sheet generated in the shearing work. Therefore, the use of the metal sheet 10 of this embodiment can improve the stretch flange crack resistance and the delayed fracture resistance when metal sheets, such as high-strength steel sheets, are applied to various components, such as panel components and structure/frame components, of automobiles. Further, the position accuracy of the metal sheet 10 in the shearing work can be improved, and therefore the application to mass production is enabled. By improving the position accuracy of the metal sheet 10, the cutting margin of the second shearing work which can be substantially applied in the application to mass production is reduced and a marked improvement of the stretch flange crack resistance and the delayed fracture resistance is obtained.

(2) This embodiment is the metal sheet 10 shearing work method, and the method includes: applying the double shearing work to the end portion of at least one part of the metal sheet 10; forming, in the first cutting in the double shearing work, the first area ARA-A having the cutting margin of the second shearing work of 5 mm or less and the projection areas ARA-B continuous to the first area ARA-A and having the cutting margin of the second shearing work larger than that of the first area ARA-A due to the fact that the projection areas ARA-B project with respect to the first area ARA-A; and carrying out the second cutting in the double shearing work in the state where the movement on the end portion side of the first area ARA-A is restrained by restraining the projection areas ARA-B.

This embodiment is a technology suitable for the case where the above-described metal sheet 10 is the high-strength steel sheet having a tensile strength of 980 MPa or more, for example.

This configuration can reduce the tensile residual stress and the work hardened layer of the sheared end surface of a steel sheet generated in the shearing work. Therefore, the use of the metal sheet 10 can improve the stretch flange crack resistance and the delayed fracture resistance when metal sheets, such as high-strength steel sheets, are applied to various components, such as panel components and structure/frame components, of automobiles. Further, the position accuracy of the metal sheet 10 in the shearing work can be improved, and therefore the application to mass production is enabled. By improving the position accuracy of the metal sheet 10, the cutting margin of the second shearing work which can be substantially applied in the application to mass production is reduced and a marked improvement of the stretch flange crack resistance and the delayed fracture resistance is obtained.

Further, the projection areas ARA-B having a relatively large cutting margin are included, and therefore scraps do not become like shavings, and therefore the treatment of the scraps is facilitated.

(3) The restraint is carried out by causing the guide member 30 to abut on the end portions of the projection areas ARA-B, for example.

This configuration can certainly restrain the movement on the end portion side of the first area ARA-A in the second cutting.

(4) For the restraint, the formation of the openings 10B in the projection areas ARA-B and the insertion of the jigs 31 into the openings 10B are carried out, for example.

According to this configuration, as a method for performing the positioning in the shearing, an area having the cutting margin of the second shearing work larger than that of the first area ARA-A is provided as the projection area ARA-B, for example. Further, the openings 10B are provided in the area, and the jigs 31 are inserted into the openings 10B before the shearing work or during the shearing work to fix the end portion side of the metal sheet 10. Thus, the movement in the cutting direction is also restrained in the second cutting, and the position accuracy can be further improved.

(5) In this embodiment, in the second cutting in the double shearing work, the guide members 30 abutting on the end surface of the first area ARA-A and restraining the movement on the end portion side of the first area ARA-A are caused to abut on the first area ARA-A to restrain the movement on the end portion side of the first area ARA-A, and the openings 10B allowing the passage of the guide members 30 in the cutting direction are formed in the upper blade 23 to be used in the second cutting.

This configuration can reduce the scrap amount to a small amount.

(6) This embodiment is a pressed component manufacturing method using the metal sheet 10 sheared by the above-described shearing work as the metal sheet 10 when the metal sheet 10 is formed into a pressed component through one or two or more times of press forming.

For example, at this time, a configuration may be acceptable in which the first cutting and the second cutting in the double shearing work are individually carried out before the final press forming of the one or two or more times of press forming, for example.

This configuration uses the metal sheet 10 having a marked improved stretch flange crack resistance as a blank. Therefore, the degree of freedom of the press forming is improved and the delayed fracture resistance of the manufactured pressed component can also be improved.

Further, the position accuracy of the metal sheet 10 is improved and the scrap treatment capability is also improved in the cutting, and therefore the application to mass production of the pressed component is facilitated.

(7) The metal sheet of this embodiment is a metal sheet to be press-formed after the end portion of at least one part is cut by shearing work and has, as the end portion to be cut: the first area having the cutting margin of the shearing work of 5 mm or less; and the projection areas continuous to the first area and having the cutting margin of the shearing work larger than that of the first area due to the fact that the projection areas project with respect to the first area.

This configuration can reduce the tensile residual stress and the work hardened layer of the sheared end surface of a steel sheet generated in the shearing work. Therefore, the use of the metal sheet 10 of this embodiment can improve the stretch flange crack resistance and the delayed fracture resistance when metal sheets, such as high-strength steel sheets, are applied to various components, such as panel components and structure/frame components, of automobiles. Further, the position accuracy of the metal sheet 10 in the shearing work can be improved, and therefore the application to mass production is enabled. By improving the position accuracy of the metal sheet 10, the cutting margin of the second shearing work which can be substantially applied in the application to mass production is reduced. As a result, a marked improvement of the stretch flange crack resistance and the delayed fracture resistance is obtained.

(8) This embodiment is the shearing die cutting the end portion of the metal sheet with the upper blade in a state where the metal sheet is restrained with the lower blade and the sheet holder, and the shearing die has the restraining tools restraining the movement on the end surface side of the end portion to be cut.

For example, the metal sheet has, as the end portion to be cut: the first area having the cutting margin of the shearing of 5 mm or less; and the projection areas continuous to the first area and having the cutting margin of the shearing larger than that of the first area due to the fact that the projection areas project with respect to the first area, and the restraining tool is configured to restrain the projection areas.

The restraining tool is configured to have the guide members abutting on the end portions of the projection areas, for example.

The restraining tool is configured to have the rod bodies penetrating through the projection areas, for example.

The restraining tool is configured to have the guide members abutting on the end surface of the end portion to be cut and the openings formed in the upper blade and allowing the passage of the guide members in the cutting direction, for example.

This configuration can reduce the tensile residual stress and the work hardened layer of the sheared end surface of a steel sheet generated in the shearing work. Therefore, the use of the metal sheet 10 of this embodiment can improve the stretch flange crack resistance and the delayed fracture resistance when metal sheets, such as high-strength steel sheets, are applied to various components, such as panel components and structure/frame components, of automobiles. Further, the position accuracy of the metal sheet 10 in the shearing work can be improved, and therefore the application to mass production is enabled. By improving the position accuracy of the metal sheet 10, the cutting margin of the second shearing work which can be substantially applied in the application to mass production is reduced and a marked improvement of the stretch flange crack resistance and the delayed fracture resistance is obtained.

EXAMPLES

Next, Examples based on this embodiment are described.

The following description is given using test materials containing two kinds of steel types A, B formed of ultrahigh-strength steel sheets having a sheet thickness of 1.4 mm.

(Effects of Double Shearing Work)

First, experiment results on the effects of the double shearing work are described.

First, a test material having a dimension before shearing of 100 mm×100 mm was used, and then the test material was cut into 100 mm×50 mm in the first cutting. Next, after the first cutting, the second cutting was carried out while changing a cutting margin, and an evaluation sample was obtained. As illustrated in Table 1, two or more of the samples were obtained while changing the cutting margin of the second cutting.

Herein, a clearance ΔD in the shearing work was set to 12.5% for both the first cutting and the second cutting. The clearance ΔD is a percentage of (d/t), which is a ratio of a gap d between the upper blade 23 and the lower blade 21 to be used to a sheet thickness t of the metal sheet 10.

Then, each of the obtained samples was measured for a residual stress of the sheared end surface after cutting by X-rays. Further, each of the obtained samples was immersed in hydrochloric acid having a pH of 3 for 96 hours under the application of a bending stress of the tensile strength, and then the presence or absence of cracks in each sample was confirmed. In the X-ray measurement, the measurement range was set to 300 μm in diameter, and a stress was measured at the center position with respect to both the sheet surface of the sheared end surface after the shearing work and the sheet thickness direction.

Table 1 shows the tensile strength of the steel types A, B constituting the test materials, the processing conditions of each sample, and the residual stress of the sheared end surface and the crack determination results of the immersion test in each sample in the evaluations above. In Table 1, the samples with "-" for the cutting margin of the second shearing are samples which were not subjected to the second cutting.

TABLE 1

| Steel type | Sheet thickness [mm] | Tensile strength [MPa] | Cutting margin of first shearing [mm] | Cutting margin of second shearing [mm] | Residual stress of sheared end surface [MPa] | Presence or absence of crack after immersion test |
|---|---|---|---|---|---|---|
| A | 1.4 | 1520 | 50 | — | 1521 | Presence |
| | | | | 0.5 | 687 | Absence |
| | | | | 1 | 732 | Absence |
| | | | | 5 | 651 | Absence |
| | | | | 30 | 1414 | Presence |
| B | | 1979 | | — | 2003 | Presence |
| | | | | 0.5 | 958 | Absence |
| | | | | 1 | 920 | Absence |
| | | | | 5 | 938 | Absence |
| | | | | 30 | 1869 | Presence |

As is understood from Table 1, it was found that the tensile residual stress of the sheared end surface decreased by performing double cutting as compared with only one cutting. However, when the cutting margin of the second cutting is 30 mm, the effect of reducing the tensile residual stress is low. However, when the cutting margin of the second cutting is set to 5 mm or less, the effect of reducing the tensile residual stress was sharply improved.

As is also understood from the crack determination results of the immersion test in Table 1, it was found that, by setting the thickness of the cutting margin of the second cutting to 5 mm or less, cracks in the immersion test were not observed and the delayed fracture resistance was also improved as compared with only one cutting.

(Cutting while End Portion Side of First Area ARA-A is Restrained)

Next, it is described that the cutting margin of the second cutting in the first area ARA-A is set to 5 mm or less, and then the second cutting is carried out by the method described in the embodiment, so that the shearing work can be stably performed.

Blanks 1, 2, 3, 4, which are samples having dimensions and shapes illustrated in FIGS. 11A to 11D, respectively, were produced using the test materials containing the steel types A, B above. In the blank 3, hole parts are formed as the openings 10B. The blanks 1, 2, 3, 4 were produced by only one shearing work or a plurality of times of shearing work, and the clearance in the cutting in the shearing work was set to 12.5%.

Herein, Example using the blanks 1, 2, 3, 4 are described as Examples 1, 2, 3, 4 in order, respectively.

Figure 12:
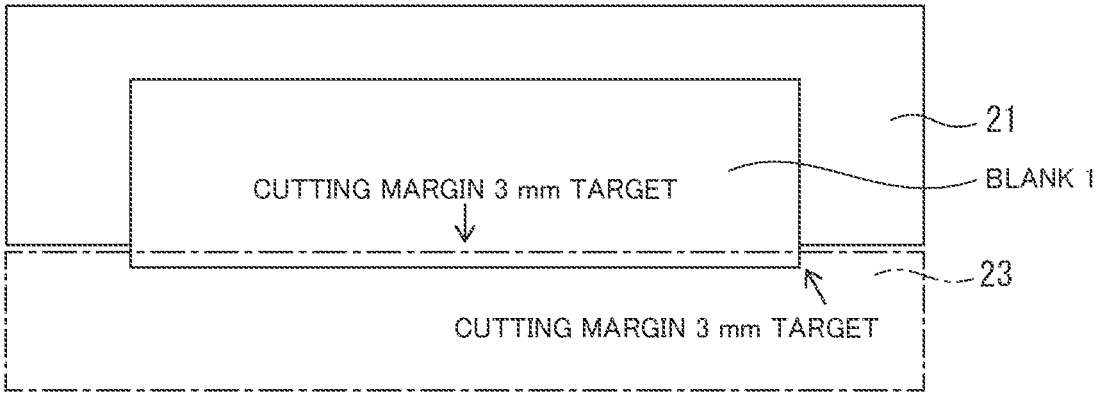
FIG. 12 is a plan view for explaining the arrangement when a blank 1 is cut in Example 1.
Figure 13:
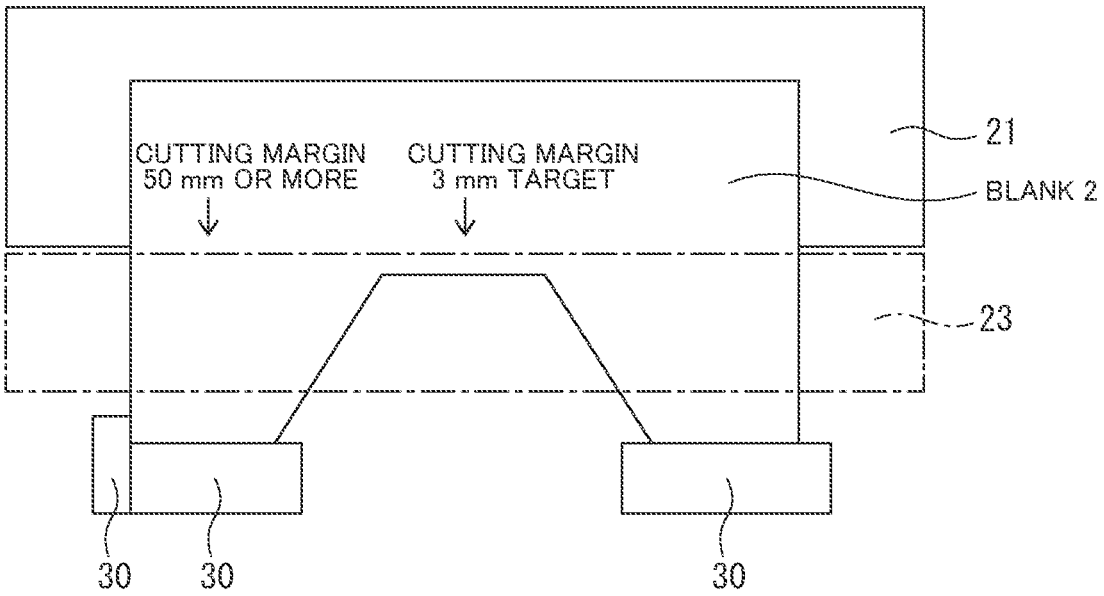
FIG. 13 is a plan view for explaining the arrangement when a blank 2 is cut in Example 2.
Figure 14:
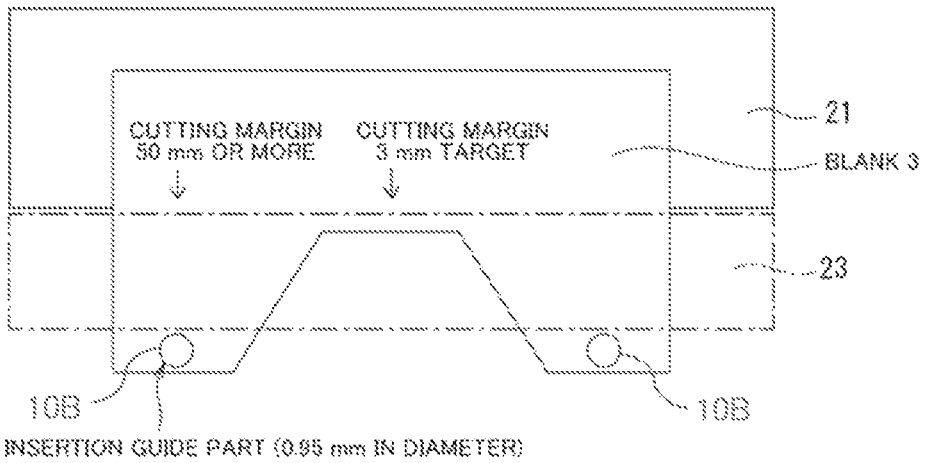
FIG. 14 is a plan view for explaining the arrangement when a blank 3 is cut in Example 3.
Figure 15:
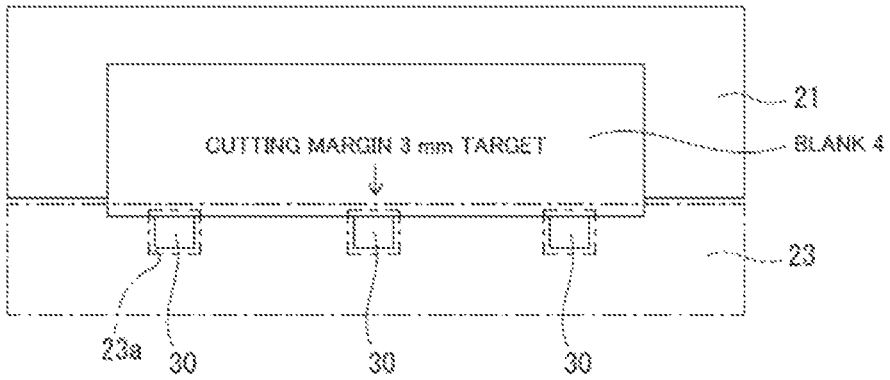
FIG. 15 is a plan view for explaining the arrangement when a blank 4 is cut in Example 4.

In Example 1, a shearing die in which the lower blade 21 and the upper blade 23 arranged to have a positional relationship as illustrated in FIG. 12 was used for the blank 1. In Example 2, a shearing die in which the lower blade 21, the guide members 30, and the upper blade 23 arranged to have a positional relationship as illustrated in FIG. 13 was used for the blank 2. In Example 3, a shearing die in which the lower blade 21, the openings 10B, the jigs 31 (indicated as insertion guide parts in FIG. 14), the guide members 30, and the upper blade 23 arranged to have a positional relationship as illustrated in FIG. 14 was used for the blank 3. In Example 4, a shearing die in which the lower blade 21 and the upper blade 23 arranged to have a positional relationship as illustrated in FIG. 15 was used for the blank 4.

Herein, in Examples 1 to 4, an end portion site where an improvement of the delayed fracture is aimed was set to a center part of each blank, and the punching margin of the cutting indicated by the positional relationship between the upper blade 23 and each blank was set to 3 mm. This is because the punching margin of the cutting is 5 mm, which is considered to be effective, while the likelihood of 2 mm was taken considering blank position variations.

At this time, to reproduce the installation of blanks obtained by mass production, the position of the blank 1 was set under common mass-production press positioning guide conditions in Example 1 (FIG. 12). In Example 2, the blank 2 was installed in a state where end portions of portions serving as the projection areas ARA-B of the blank 2 were pressed against the guide members 30 (FIG. 13). In Example 3, the blank 3 was installed in a state where the jigs 31 were caused to penetrate through the openings 10B provided at the positions where the projection areas ARA-B were formed of the blank 3 (FIG. 14). In Example 4, the blank 4 was installed in a state where an end portion equivalent to the first area ARA-A of the blank 4 was pressed against the four guide members 30 (FIG. 15).

Next, in each example, the position of the blank after the blank was installed in a shearing die (cutting device) was measured, and the maximum change amount in the punching margin of the second cutting was defined and measured as the blank position accuracy.

Thereafter, in each example, the body 10A side was restrained with the sheet holder 22 while the blank position was left as it was, and then the shearing work was carried out. The clearance in the shearing work was set to 12.5%. The restraining force by the sheet holder 22 was set to be the same in all Examples.

Table 2 shows the evaluation results in each Example.

TABLE 2

| Steel type | Example | Blank position accuracy/mm | Number of double shearing work failures | Number of delayed fractures after immersion test | Scrap treatment capability |
|---|---|---|---|---|---|
| A | 1 | 5.7 | 2/5 | 2/3 | Poor |
| | 2 | 0.3 | 0/5 | 0/5 | Good |
| | 3 | 0.05 | 0/5 | 0/5 | Good |
| | 4 | 0.4 | 0/5 | 0/5 | Acceptable |
| B | 1 | 5.4 | 2/5 | 2/3 | Poor |
| | 2 | 0.4 | 0/5 | 0/5 | Good |
| | 3 | 0.05 | 0/5 | 0/5 | Good |
| | 4 | 0.3 | 0/5 | 0/5 | Acceptable |

Herein, some blanks were greatly displaced in the cutting, so that the blanks were not able to be sheared with the entire end surface of the upper blade 23. In that case, the sample (scrap) on the punched-out side was divided into plurality of pieces. This case was described as "Double shearing work failure", and recorded as "n/5", in which the number of the "Double shearing work failure" was set as n.

The samples produced by the cutting in each Example were immersed in hydrochloric acid having a pH of 3 for 96 hours under the application of a bending stress of the tensile strength, and an improvement of the delayed fracture characteristics was confirmed. Therefore, the presence or absence of cracks in the center part of each sample where the improvement effect by the double shearing work was aimed was confirmed. Of m samples in which the double shearing work was successfully performed, the number of samples in which cracks were observed is defined as n, and the number of delayed fractures after the immersion test "n/m" (cracks) was recorded.

The scrap shape on the cut-off side was confirmed. Then, it was considered that, when all the scraps sufficiently have an area with a width of 5 mm or more, the scrap treatment capability was high. Then, a case where the scrap treatment capability is high was evaluated as "Good" and a case where the scrap treatment capability is not high was evaluated as "poor". Among the poor samples, however, the samples in which the scrap shape is stable due to the improvement of the blank position accuracy were evaluated as "Acceptable".

VERIFICATION OF EXAMPLES

Table 2 shows the blank position accuracy, the number of double shearing work failures, the number of delayed fractures after the immersion test, and the scrap treatment capability for Examples 1 to 4 in the steel types A, B.

In Example 1, the end portion side of the blank was not restrained, and the cutting was carried out in a cantilevered state. Therefore, some blanks 1 failed in the double shearing work, and the remaining blank partly had a cutting margin larger than 5 mm, so that the delayed fracture occurred.

On the other hand, in Examples 2, 3, 4 based on the present invention, the cutting was carried out while the end portion side of each blank was restrained. Therefore, the blank position accuracy was improved. More specifically, in Example 2, 3, 4, all the blanks succeeded in the double shearing work due to the improvement of the blank position accuracy, and the delayed fracture was suppressed.

The scrap treatment capability was poor in Example 1. However, the scrap treatment capability was good in Examples 2, 3. In Example 4, the scrap size is small, but the scrap shape is stable, and therefore the scrap treatment capability was evaluated as "Acceptable". Therefore, it was found that Examples 2, 3, 4 contributed to the improvement of the mass productivity of the processing by the double shearing work also from the viewpoint of the scrap treatment capability.

Herein, the entire contents of JP 2020-112738 A (filed Jun. 30, 2020), for which this application claims priority, form part of this disclosure by reference. Herein, the description is given with reference to a limited number of embodiments, but the scope of the invention is not limited thereto and modifications of each embodiment based on the disclosure above are obvious to those skilled in the art.

| Reference Signs List | |
|---|---|
| 1 | trim step |
| 1A | double shearing work |
| 2 | press step |
| 10 | metal sheet |
| 10A | body |

-continued

| Reference Signs List | |
|---|---|
| 10B | opening |
| 21 | lower blade |
| 22 | sheet holder |
| 23 | upper blade |
| 23a | opening |
| 30 | guide member |
| 31 | jig |
| ARA-A | first area |
| ARA-B | projection area |

The invention claimed is:

1. A metal sheet shearing work method for shearing work a metal sheet, the method comprising:

applying double shearing work to an end portion of at least one part of a metal sheet;

forming a first area having a cutting margin of second shearing work of 5 mm or less in first cutting in the double shearing work, and carrying out second cutting in the double shearing work in a state where movement on an end portion side of the first area is restrained.

2. The metal sheet shearing work method according to claim 1, wherein:

in the first cutting in the double shearing work, further forming a projection area continuous to the first area and having the cutting margin of the second shearing work larger than the cutting margin of the second shearing work of the first area due to a fact that the projection area projects with respect to the first area, and the second cutting in the double shearing work is carried out in a state where movement on the end portion side of the first area is restrained by restraining the projection area.

3. The metal sheet shearing work method according to claim 2, wherein the restraint of the projection area is carried out by causing a guide member to abut on an end portion of the projection area.

4. The metal sheet shearing work method according to claim 2, wherein, for the restraint of the projection area, formation of an opening in the projection area and insertion of a jig into the opening are carried out.

5. The metal sheet shearing work method according to claim 1, wherein in the second cutting in the double shearing work, a guide member is caused to abut on an end surface of the first area to restrain the movement on the end portion side of the first area, and an opening allowing passage of the guide member in a cutting direction is formed in an upper blade to be used in the second cutting.

6. The metal sheet shearing work method according to claim 1, wherein the metal sheet has a tensile strength of 980 MPa or more.

7. A pressed component manufacturing method comprising:

when a metal sheet is formed into a pressed component through one or two or more times of press forming, using a metal sheet by the metal sheet shearing work method according to claim 1 as the metal sheet.

8. The pressed component manufacturing method according to claim 7, wherein the first cutting and the second cutting in the double shearing work are individually carried out before final press forming of the one or two or more times of press forming.

9. A metal sheet, the metal sheet being press-formed after an end portion of at least one part is cut by shearing work, the metal sheet comprising, as the end portion to be cut:

a first area having a cutting margin of the shearing work of 5 mm or less; and a projection area continuous to the first area and having the cutting margin of the shearing work larger than the cutting margin of the shearing work of the first area due to a fact that the projection area projects with respect to the first area.

10. A shearing die for metal sheet, the shearing die cutting an end portion of a metal sheet with an upper blade in a state where the metal sheet is restrained with a lower blade and a sheet holder, the shearing die comprising:

a restraining tool configured to restrain movement on an end surface side of the end portion to be cut.

11. The shearing die for metal sheet according to claim 10, wherein the metal sheet has, as the end portion to be cut:

a first area having a cutting margin of 5 mm or less; and a projection area continuous to the first area and having the cutting margin larger than the cutting margin of the first area due to a fact that the projection area projects with respect to the first area, and the restraining tool is configured to restrain the projection area.

12. The shearing die for metal sheet according to claim 11, wherein the restraining tool has a guide member abutting on an end portion of the projection area.

13. The shearing die for metal sheet according to claim 11, wherein the restraining tool has a rod body penetrating through the projection area.

14. The shearing die for metal sheet according to claim 10, wherein the restraining tool has:

a guide member configured to abut on the end surface of the end portion to be cut; and an opening formed in the upper blade and allowing passage of the guide member in a cutting direction.

15. The metal sheet shearing work method according to claim 3, wherein, for the restraint of the projection area, formation of an opening in the projection area and insertion of a jig into the opening are carried out.

16. A pressed component manufacturing method comprising:

when a metal sheet is formed into a pressed component through one or two or more times of press forming, using a metal sheet by the metal sheet shearing work method according to claim 2 as the metal sheet.

17. A pressed component manufacturing method comprising:

when a metal sheet is formed into a pressed component through one or two or more times of press forming, using a metal sheet by the metal sheet shearing work method according to claim 3 as the metal sheet.

18. A pressed component manufacturing method comprising:

when a metal sheet is formed into a pressed component through one or two or more times of press forming, using a metal sheet by the metal sheet shearing work method according to claim 4 as the metal sheet.

19. A pressed component manufacturing method comprising:

when a metal sheet is formed into a pressed component through one or two or more times of press forming, using a metal sheet by the metal sheet shearing work method according to claim 5 as the metal sheet.

20. The shearing die for metal sheet according to claim 12, wherein the restraining tool has a rod body penetrating through the projection area.

* * * * *